US008241046B2

(12) United States Patent
Takagi et al.

(10) Patent No.: US 8,241,046 B2
(45) Date of Patent: Aug. 14, 2012

(54) CONNECTOR SHELL WITH A MOUNTING PIECE HAVING A SECTIONAL REDUCING PART WITH A GROOVE ADJOINING AN OPENING

(75) Inventors: Soichi Takagi, Tokyo (JP); Takaki Tsutsui, Tokyo (JP); Tsuyoshi Eguchi, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 13/070,765

(22) Filed: Mar. 24, 2011

(65) Prior Publication Data

US 2011/0237094 A1 Sep. 29, 2011

(51) Int. Cl.
*H01R 12/00* (2006.01)

(52) U.S. Cl. ..... 439/83

(58) Field of Classification Search ..... 439/83, 439/70, 79, 55; 361/773; 174/261, 255
See application file for complete search history.

(56) References Cited

U.S. PATENT DOCUMENTS

| | | | | |
|---|---|---|---|---|
| 3,784,955 | A * | 1/1974 | Reynolds et al. | 439/79 |
| 4,541,034 | A * | 9/1985 | Fanning | 361/773 |
| 4,575,167 | A * | 3/1986 | Minter | 439/83 |
| 6,570,280 | B2 * | 5/2003 | Takahashi | 310/71 |

FOREIGN PATENT DOCUMENTS

| | | |
|---|---|---|
| JP | 2005-243468 | 8/2005 |
| JP | 2005-246424 | 8/2005 |

* cited by examiner

*Primary Examiner* — Chandrika Prasad
(74) *Attorney, Agent, or Firm* — Whitham, Curtis, Christofferson & Cook, PC

(57) ABSTRACT

A connector shell to be mounted on a board includes a shell body and a mounting piece. In the shell body, a plug inserting space is defined. The mounting piece is integral with the shell body, and is extended from the shell body through the board to be fixed to the board by soldering. A sectional area reducing part is provided in the mounting piece between the shell body and a distal end part of the mounting piece. The sectional area reducing part has a sectional area smaller than a sectional area at the distal end part, and is disposed so as to face the plug inserting space.

1 Claim, 2 Drawing Sheets

CONNECTOR SHELL WITH A MOUNTING PIECE HAVING A SECTIONAL REDUCING PART WITH A GROOVE ADJOINING AN OPENING

BACKGROUND

The present invention is related to a connector shell which is used in a receptacle into which a plug is to be inserted.

A receptacle into which a plug is inserted thereby to establish electrical connection between electronic parts is known. This receptacle is required to be made compact like other electronic parts. Further, the receptacle is surface mounted on a surface of a board by solder reflowing method, in the same manner as the other electronic parts.

A sectional view of a conventional receptacle 100 is shown in FIG. 4. The receptacle 100 includes a connector shell 101 having a substantially rectangular tubular shape in which a plug insertion space is defined. A plug guiding piece 104 is disposed in the plug insertion space, and connecting terminals 105 which are provided on the plug guiding piece 104 can be electrically continued to terminals at a plug side. The connector shell 101 has a shell body 102 and mounting pieces 103 extended from the shell body 102 toward a board 106. The receptacle 100 is mounted on the board 106 by fixing the mounting pieces 103 to the board 106 by soldering.

When the connector shell 101 is fixed by soldering to the board 106, solder must be adhered to the mounting pieces 103. This can be accomplished by heating the mounting pieces 103 up to a solder melting temperature. When this is done, the shell body 102 is also heated together with the mounting pieces 103. During a reflow treatment, more than a required amount of solder 110 may be conveyed to side walls of the shell body 102 along the mounting pieces 103. Represented by marks A in FIG. 4 are the solders 110 which have crept up to the plug insertion space and have been solidified. When this happens, it has been feared that the solidified solders may interfere with the plug to be inserted, and the plug cannot be inserted up to a determined position.

It is necessary to take some countermeasures for reliably preventing the solders from creeping up. As an art for preventing the creeping up of the solders, there has been known such an art that a solder wicking prevention layer is formed above a region to be soldered, thereby to prevent the solder from creeping up higher than the solder wicking prevention layer.

In Patent Document 1, there is disclosed a method for forming a solder wicking prevention zone by applying resin or ceramics having a low wettability with respect to the solder, to a contact part of a connector member.

Moreover, in Patent Document 2, there is disclosed such an art that a soldering region is formed in a terminal part to be soldered, by providing a plating layer of gold to which the solder is likely to adhere, on an under layer of nickel, and further, a laser beam is irradiated to an upper part of this soldering region thereby to form a layer of nickel and gold alloy having a low wettability with respect to the solder, and thus, a solder creeping prevention region is formed.

[Patent Document 1] Japanese Patent Publication No. 2006-246424

[Patent Document 2] Japanese Patent Publication No. 2005-243468

SUMMARY

Although the arts for preventing the creeping up of the solder as described above have been known, working steps are increased in these methods, because the resin or ceramics is applied or a laser work is conducted. It is therefore one advantageous aspect of the present invention to provide a connector shell in which creeping up of solder can be prevented by a simple method and at a low cost.

According to one aspect of the invention, there is provided a connector shell to be mounted on a board, comprising:

a shell body in which a plug inserting space is defined;

a mounting piece which is integral with the shell body, extended from the shell body through the board to be fixed to the board by soldering; and a sectional area reducing part, provided in the mounting piece between the shell body and a distal end part of the mounting piece, having a sectional area smaller than a sectional area at the distal end part, and disposed so as to face the plug inserting space.

The sectional area reducing part may be formed by an opening provided in the mounting piece.

The connector shell may be configured such that a groove is formed in the mounting piece and extends from the distal end part to the opening so as to guide solder to the opening.

A width of the opening may be larger than a width of the groove.

DETAILED DESCRIPTION OF EXEMPLIFIED EMBODIMENTS

Exemplified embodiments of the invention are described below in detail with reference to the accompanying drawings.

Figure 1:
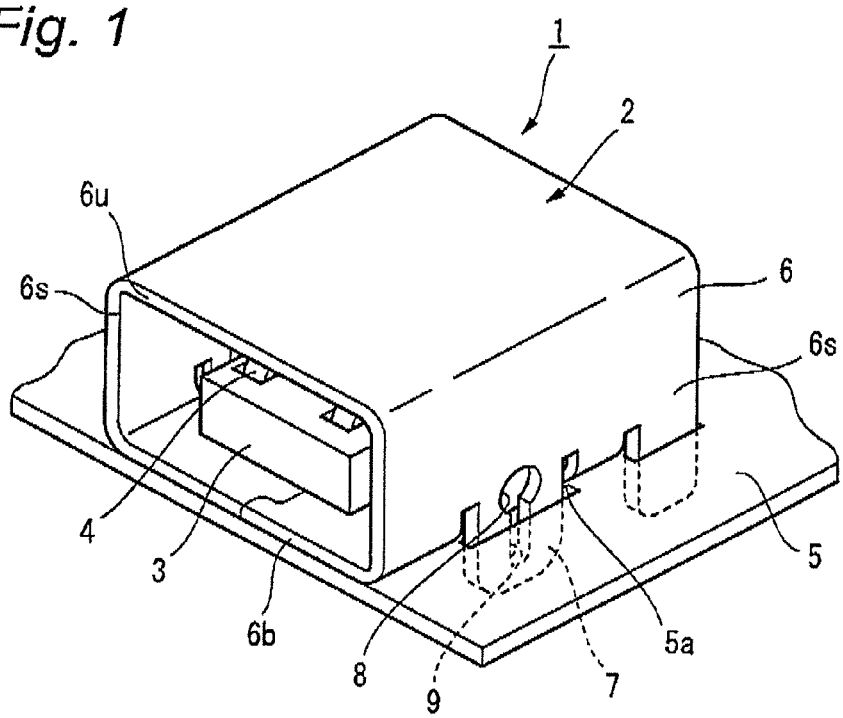
FIG. 1 is a perspective view of a receptacle using a connector shell according to a first embodiment of the invention.

FIG. 1 is a perspective view of a receptacle 1 to which a connector shell 2 according to a first embodiment of the invention is applied. The receptacle 1 is mounted on a board 5, and includes the connector shell 2 which has a plug insertion space inside, a plug guiding piece 3 which is disposed in the plug insertion space, and connecting terminals 4 which are provided on the plug guiding piece 3 and can be electrically continued to plug side terminals.

When a plug, which is not shown, is inserted into the plug insertion space in the connector shell 2, while it is guided by the plug guiding piece 3, the plug side terminals are electrically continued to the connecting terminals 4, and thus, electrical connection is established between both the terminals.

The connector shell 2 has a shell body 6 in a substantially rectangular tubular shape, and a pair of mounting pieces 7 which are extended from the shell body 6 toward the board 5. The shell body 6 is formed into a substantially rectangular tubular shape, by folding a sheet of conductive metal plate which has been stamped out into a substantially rectangular shape. The shell body 6 has a bottom wall **6*b* to be brought into contact with the board 5, a pair of side walls 6*s*, and an upper wall 6*u* which is opposed to the bottom wall 6*b***.

A pair of the mounting pieces 7 are integral with the shell body 6 and are projected from a pair of the side walls **6*s*. These mounting pieces 7 are integrally formed with the shell body 6 by stamping out the metal plate which is material for the shell body 6** into a substantially U-shape, and subjecting it to a folding work.

The mounting piece 7 is extended from the shell body 6 through the board 5 to be fixed to the board by soldering. In other words, distal ends of the mounting pieces 7 are extended from the shell body 6 to an opposite side of the plug insertion space, interposing a board mounting base plane, inserted into mounting holes 5*a* which are provided in the board 5, and then, soldered. In this embodiment, the board mounting base plane is an inner face of the bottom wall 6*b* of the shell body 6 which constitutes a side of the plug insertion space to be opposed to the board 5.

Between the distal end of each of the mounting pieces 7 and the shell body 6, an opening 8 which forms a sectional area reducing part for reducing a sectional area of the mounting piece 7 is formed. The opening 8 is formed by stamping out the metal plate in a round shape, when the shell body 6 is formed out of the metal plate.

Because the opening 8 is formed, the sectional area of the mounting piece 7 is reduced from the distal end of the mounting piece 7 to the shell body 6. In other words, the sectional area of the mounting piece 7 in a plane parallel to the board 5 at a position of the opening 8 is made smaller as compared with the sectional area of the mounting piece 7 at the distal end side thereof.

On the occasion of soldering, it is necessary to heat a member to be soldered up to a solder melting temperature. When the distal end of the mounting piece 7 is heated, the heat is transmitted to the shell body 6 along the mounting piece 7. Generally, calories which are transmitted through the member in a determined time are proportional to a sectional area of the member. Therefore, in the case where the sectional area of the mounting piece 7 which is a heat transmitting passage from the mounting piece 7 to the shell body 6 is reduced by the opening 8, the calorie to be transmitted from the distal end of the mounting piece 7 to the shell body 6 in a determined time is reduced. In short, heat transmission from the distal end of the mounting piece 7 to the shell body 6 is depressed by the opening 8. Therefore, even though the mounting piece 7 is heated up to the solder melting temperature, the shell body 6 will not be heated up to the solder melting temperature. As the results, it is possible to prevent the solder from adhering to the shell body 6.

Moreover, the opening 8 is disposed so as to face the plug inserting space. In other words, this opening 8 is open to a side more close to the plug insertion space than to the inner face (the board mounting base plane) of the bottom wall 6*b* of the shell body 6. Therefore, it is possible to store the molten solder in the opening 8, even though the solder creeps up from the board 5 to the plug insertion space. Therefore, it is possible to prevent the solder from intruding into the plug insertion space and being solidified. Thus, it is possible to reliably prevent the plug from interfering with the solder, when the plug is inserted into the plug insertion space.

Further, the mounting piece 7 is provided with a groove 9 which is extended from the distal end side thereof toward the opening 8 and adapted to guide the molten solder to the opening 8. This groove 9 is also formed by stamping out the metal plate in a slit-like shape, when the shell body 6 is formed out of the metal plate. The groove 9 can reliably guide the molten solder which creeps up from the board 5 at a time of soldering, and so, it is possible to store the solder in the opening 8.

Moreover, because a volume of the mounting piece 7 at the distal end side thereof is partly reduced by the groove 9, and hence, heat capacity of the mounting piece 7 at the distal end side can be decreased. Accordingly, the distal end of the mounting piece 7 can be heated almost up to the solder melting temperature in a short time, and so, the calories to be transmitted to the shell body 6 can be reduced. As the results, the shell body 6 is restrained from being heated up to the solder melting temperature, and hence, it is possible to prevent the solder from creeping up to the shell body 6.

The opening 8 and the groove 9 can be formed simply by stamping out the metal plate in a round shape or in an oblong shape, when the shell body 6 is formed out of the metal plate. Therefore, it is possible to reliably prevent the creeping up of the solder easily and at a lower cost, as compared with a case where resin or ceramics is applied or a laser work is conducted.

It is to be noted that the sectional area to be reduced by the opening 8 is larger than the sectional area to be reduced by the groove 9. In other words, a width of the opening 8 formed by cutting is made larger than a width of the groove 9 formed by cutting. When the molten solder creeps up to the plug insertion space, while it fills the groove 9 at the time of soldering, a liquid level of the molten solder which is stored in the opening 8 is unlikely to rise, because the opening 8 which is provided at a side close to the plug insertion space has the larger width. As the results, it is possible to restrain intrusion of the solder into the plug insertion space.

Figure 2:
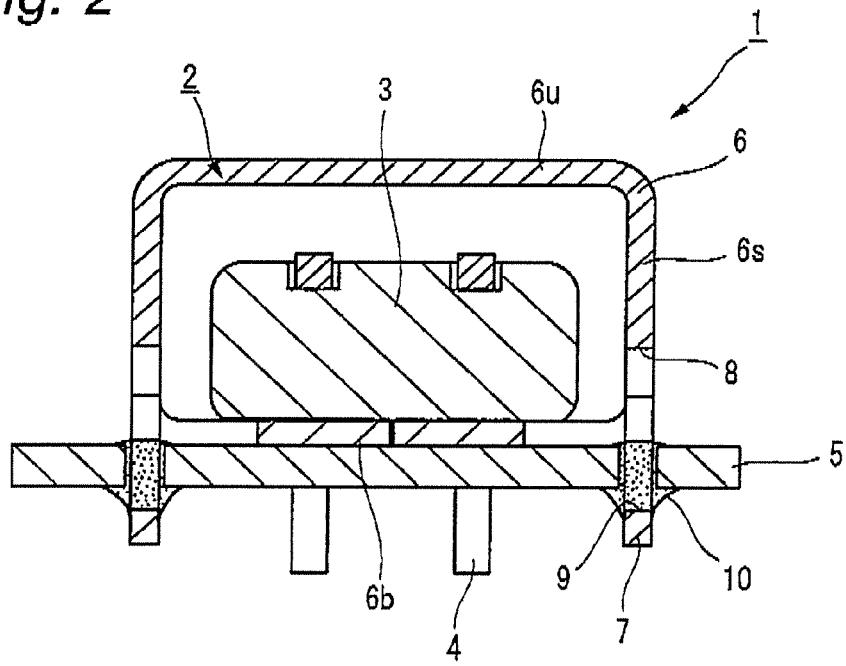
FIG. 2 is a sectional view of the receptacle in FIG. 1.

Advantages of the receptacle 1 according to the above described embodiment will be described referring to FIG. 2. FIG. 2 is a vertical sectional view of the receptacle 1 which is fixed to the board 5 by soldering, including the opening 8.

When the receptacle 1 is soldered to the board 5, the heat transmission from the mounting piece 7 to the shell body 6 is depressed by the opening 8 which is the sectional area reducing part. Therefore, the shell body 6 will not be heated up to the solder melting temperature, even though the mounting piece 7 is heated for soldering. Accordingly, the solder 10 which creeps along the mounting piece 7 from the distal end of the mounting piece 7 up to the plug insertion space will not adhere to the shell body 6, and the solder 10 which has crept up will not intrude into the plug insertion space. As the results, it is possible to prevent the plug from interfering with the solder 10.

Figure 3:
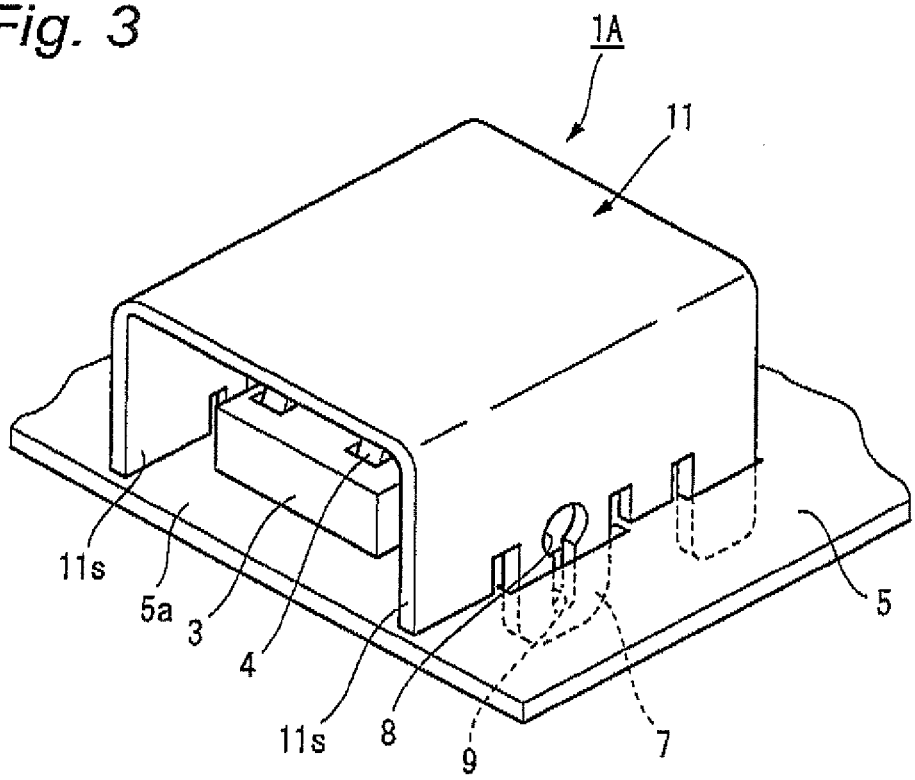
FIG. 3 is a perspective view of a receptacle using a connector shell according to a second embodiment of the invention.
Figure 4:
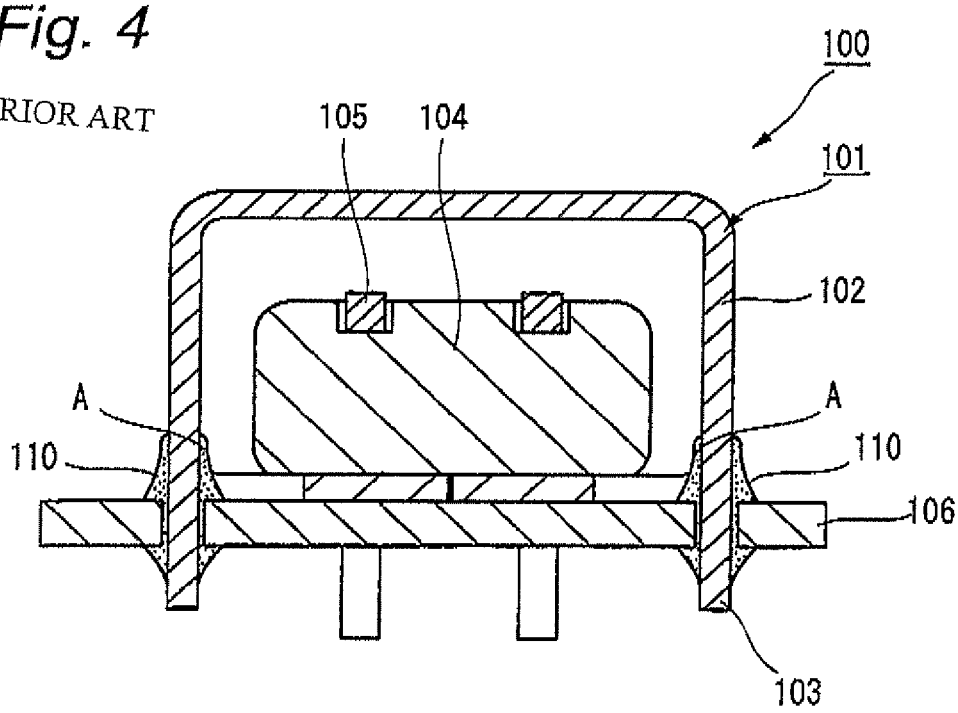
Fig. 4 PRIOR ART
FIG. 4 is a sectional view of a conventional receptacle.

FIG. 3 is a perspective view showing a receptacle 1A according to a second embodiment of the invention. Although the shell body 6 in a substantially rectangular tubular shape is used in the first embodiment, a shell body 11 in a substantially U-shape in section is used in the second embodiment.

In the second embodiment, the shell body 11 is a member having a substantially U-shape in section which is formed by folding a metal plate, and provided with no bottom wall. In this shell body 11 in a substantially U-shape, by bringing open end parts 11*s* in a U-shape into contact with a mounting face 5*a* of the board 5, the plug insertion space is defined by the board 5 and the shell body 11.

In this case, the mounting face 5*a* of the board 5 to be opposed to the shell body 11 corresponds to the board mounting base plane, and the distal end of the mounting piece 7 is extended from a side wall of the shell body 11 at a side of the plug insertion space to the opposite side, interposing the mounting face 5*a* of the board 5 which is the board mounting base plane.

In this manner, even in the receptacle 1A having no bottom wall, it is possible to prevent the solder from creeping up to the plug insertion space, by the opening 8 which is positioned between the distal end of the mounting piece 7 and the shell body 11, and more close to the plug insertion space than to the board mounting base plane, in the same manner as in the first embodiment.

Although only some exemplary embodiments of the invention have been described in detail above, those skilled in the art will readily appreciated that many modifications are possible in the exemplary embodiments without materially departing from the novel teachings and advantages of the invention. Accordingly, all such modifications are intended to be included within the scope of the invention.

In the above described first and second embodiments, the description has been made referring to the connector shell in a substantially rectangular tubular shape, as an example. However, the shape of the connector shell is not particularly limited, but may be a cylindrical shape and so on.

Moreover, in the above described embodiments, the sectional area reducing part (the opening 8) in a round shape is shown. However, the invention is not limited to this, but the sectional area reducing part may have a rectangular shape or a triangular shape, for example. Moreover, in the above described embodiments, a case where the single sectional area reducing part is provided is described, but a plurality of the sectional area reducing parts may be provided. Further, in the embodiments, a case where the sectional area reducing part is provided at a center of the mounting piece 7 is shown. However, the sectional area reducing part may be provided in a side part of the mounting piece 7, as slits in a shape of being cut from both sides of the mounting piece 7. In short, the shape of the sectional area reducing part is not limited, provided that the sectional area can be reduced so that the heat transmission from the mounting piece 7 to the shell body 6 or 11 may be depressed.

What is claimed is:

1. A connector shell to be mounted on a board, comprising:

a shell body in which a plug inserting space is defined;

a mounting piece which is integral with the shell body, extended from the shell body through the board to be fixed to the board by soldering; and a sectional area reducing part, provided in the mounting piece between the shell body and a distal end part of the mounting piece, having a sectional area smaller than a sectional area at the distal end part, and disposed so as to face the plug inserting space, wherein the sectional area reducing part is formed by an opening provided in the mounting piece, a groove is formed in the mounting piece and extends from the distal end part to the opening so as to guide solder to the opening, and a sectional area of the sectional area reducing part is smaller than a sectional area of a part of the mounting piece where the groove is formed.

* * * * *